US008882224B2

(12) United States Patent
Ogimura

(10) Patent No.: US 8,882,224 B2
(45) Date of Patent: Nov. 11, 2014

(54) PRINTING APPARATUS AND PRINTING METHOD

(71) Applicant: Seiko Epson Corporation, Tokyo (JP)

(72) Inventor: Takafumi Ogimura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 13/625,332

(22) Filed: Sep. 24, 2012

(65) Prior Publication Data

US 2013/0076822 A1 Mar. 28, 2013

(30) Foreign Application Priority Data

Sep. 22, 2011 (JP) ..... 2011-207469

(51) Int. Cl.

| | |
|---|---|
| ***B41J 29/38*** | (2006.01) |
| ***B41J 2/01*** | (2006.01) |
| ***B41J 19/20*** | (2006.01) |
| ***B41J 11/00*** | (2006.01) |

(52) U.S. Cl.

CPC ..... *B41J 29/38* (2013.01); *B41J 19/202* (2013.01); *B41J 11/006* (2013.01)

USPC ..... 347/14; 347/16; 347/104

(58) Field of Classification Search

CPC ..... B41J 19/202; B41J 11/0095; B41J 29/38; B41J 11/006; B41J 11/008; B41J 13/0009

USPC ..... 347/14, 16, 29–35, 104

See application file for complete search history.

(56) References Cited

U.S. PATENT DOCUMENTS

| | | | | |
|---|---|---|---|---|
| 2009/0169222 | A1 * | 7/2009 | Watanabe | 399/21 |
| 2010/0245432 | A1 * | 9/2010 | Takeda et al. | 347/14 |
| 2012/0007904 | A1 * | 1/2012 | Anzai et al. | 347/9 |

FOREIGN PATENT DOCUMENTS

| | | | |
|---|---|---|---|
| JP | 2007-296663 | A | 11/2007 |
| JP | 2011-079186 | A | 4/2011 |

* cited by examiner

*Primary Examiner* — Jannelle M Lebron

(74) *Attorney, Agent, or Firm* — Nutter McClennen & Fish LLP; John J. Penny, Jr.; Joshua I. Rudawitz

(57) ABSTRACT

When a paper jam is detected, in the case where the cause of the paper jam is a CR motor error in which the speed of the carriage is decreased by as much as a load when the paper jam occurs and becomes equal to or less than a set speed, when there is an instruction to continue printing, cleaning is performed on a printing head. In this case, it is determined whether the paper position is particularly in a one-side supporting range in which the paper is supported by only one pair of transporting roller pairs provided in each of an upstream side and a downstream side of a transporting direction of the paper with interposing of a moving path of the printing head. Then, it is preferable that cleaning be performed as long as the paper position is in the one-side supporting range.

3 Claims, 11 Drawing Sheets

ONE-SIDE SUPPORTING RANGE
($y \leq Y1$, $y \leq Y2$)

BOTH-SIDE SUPPORTING RANGE
($Y1 < y < Y2$)

PRINTING APPARATUS AND PRINTING METHOD

BACKGROUND

1. Technical Field

The present invention relates to a printing apparatus and a printing method which perform control to prevent an ejection error of a liquid ejecting head caused by the contact of a recording medium with the a liquid ejecting head when a printing medium is jammed.

2. Related Art

For example, as this kind of printing apparatus, a serial type printing apparatus is known which performs printing on paper (a printing medium) by moving a carriage in a main scanning direction and ejecting ink drops from nozzles of a printing head (a liquid ejecting head) provided in the carriage (refer to JP-A-2011-079186 (for example, paragraphs [0062] to [0066], [0078] and the like in the specification), and JP-A-2007-296663 (for example, paragraphs [0010], [0038] to [0066], [0078] and the like in the specification)).

The printer disclosed in JP-A-2011-079186 (for example, paragraphs [0062] to [0066], [0078] and the like in the specification) includes a detecting apparatus which detects whether there is a nozzle incapable of ejecting ink drops, and as a result of the detection, when it is determined that there are a predetermined number or more of nozzles incapable of ejecting ink drops, cleaning in which ink is forced to be discharged from plural nozzles is performed. Moreover, in this printer, when a paper jam is detected, the control of varying the intensity of the cleaning performed when it is determined that there are a predetermined number or more of nozzles incapable of ejecting ink drops is performed.

In addition, in the printer disclosed in JP-A-2007-296663 (for example, paragraphs [0010], [0038] to [0066], and the like in the specification), an ink suction unit which stores a capping state of a cap unit which caps a printing head is controlled to suck ink from the printing head in the case where the capping state is a state yet to be capped, and not to suck the ink from the printing head in the case where the capping state is a state already capped when an error is being recovered from.

However, in a printer not including the detecting apparatus which can detect the nozzle incapable of ejecting ink drops disclosed in JP-A-2011-079186 (for example, paragraphs [0062] to [0066], [0078] and the like in the specification), since there is no way to find out whether there is a nozzle incapable of ejecting ink drops, it is necessary to evenly perform cleaning after a paper jam occurs to reliably prevent the occurrence of the ejection error caused by the nozzle incapable of ejecting ink drops.

Even during the paper jam, in the case where there is the paper jam in a transportation system, the paper may not be in contact with a nozzle forming surface of the liquid ejecting head in some cases. When the cleaning is evenly performed even in this case, wasteful cleaning is performed. When the number of the wasteful cleaning operations is increased, the used amount of ink is increased in vain so that an ink cartridge is frequently replaced. Furthermore, with the configuration of evenly performing cleaning, there is another problem that standby time from giving an instruction to continue printing to starting print is usually generated due to performing cleaning.

In JP-A-2007-296663 (for example, paragraphs [0010], to [0066], [0078] and the like in the specification), the ink suction unit is controlled to suck the ink in the case where the capping state is a state yet to be capped, and not to suck the ink in the case where the capping state is a state already capped when an error such as a paper jam error is being recovered from. For this reason, in a state of the paper jam error, when the capping state is a state already capped, it is unnecessary to suck the wasteful ink. However, it is necessary to provide a capping state storage unit which stores a capping state, and an extra process such as a flag process to store the capping state.

SUMMARY

An advantage of some aspects of the invention is to provide a printing apparatus and a printing method which are capable of decreasing an occurrence frequency of an ejection error of liquid by performing necessary cleaning after a paper jam is released while suppressing unnecessary cleaning on a liquid ejecting head when a printing medium is jammed.

According to an aspect of the invention, there is provided a printing apparatus including a driving unit that moves a carriage having a liquid ejecting head which ejects liquid to a printing medium; a cleaning unit that performs cleaning on the liquid ejecting head; a detecting unit that detects a jam based on decreased moving speed of the carriage to a set speed or less which allows estimation of the occurrence of a jam of the printing medium; a control unit that controls the driving unit to move the carriage and stops the driving of the driving unit to stop the carriage movement when the detecting unit detects the jam; an instruction unit that is operated to give an instruction to continue printing after the jam is released; and a cleaning control unit that causes the cleaning unit to perform cleaning on the liquid ejecting head when the instruction to continue printing is given from the instruction unit.

According to the aspect of the invention, the detecting unit detects the jam of the printing medium based on decreased moving speed of the carriage to a set speed or less which allows estimation of the occurrence of a jam of a recording medium. When the jam is detected, the control unit stops the driving of the driving unit to stop the moving carriage. For example, a user releases the jam by removing the jammed printing medium, and operates the instruction unit to give an instruction to continue printing. The cleaning control unit causes the cleaning unit to perform cleaning on the liquid ejecting head when the instruction to continue printing is given from the instruction unit.

It is preferable that the printing apparatus further include a transporting unit which transports the printing medium in a transporting direction crossing a moving direction of the carriage and has a pair of transporting rollers in each of an upstream side and a downstream side of the transporting direction with respect to the liquid ejecting head; and a determination unit that determines whether the printing medium is in a one-side supporting state in which the printing medium is supported by only one of the pairs of transporting rollers or in a both-side support state in which the printing medium is supported by both of the pairs of transporting rollers when the detecting unit detects the jam of the printing medium. When the instruction to continue printing is given from the instruction unit, it is preferable that the cleaning control unit cause the cleaning unit to perform cleaning in the case where it is determined that the printing medium is in the one-side supporting state by the determination unit, and the cleaning control unit cause the cleaning unit not to perform cleaning in the case where it is determined that the printing medium is in the both-side support state.

According to the aspect of the invention, when the instruction to continue printing is given from the instruction unit after the jam of the printing medium is released, the determination unit determines whether the printing medium is in the one-side supporting state in which the printing medium is supported by only one of the pairs of transporting rollers or in the both-side support state in which the printing medium is supported by both of the pairs of transporting rollers. Then, the cleaning control unit causes the cleaning unit to perform cleaning in the case where it is determined that the printing medium is in the one-side supporting state by the determination unit, and the cleaning control unit causes the cleaning unit not to perform cleaning in the case where it is determined that the printing medium is in the both-side support state. When the printing medium is in the both-side support state, the printing medium rises little and there is a high probability of there being no jams. Therefore, wasteful cleaning does not need to be performed.

It is preferable that the printing apparatus further include a carriage position detecting unit that detects a position of the carriage in the moving direction; and a carriage position determination unit that determines whether a distance from an end position of a carriage movement start position to the stopped carriage position at the time of the jam detection exceeds a threshold value in the printing medium. When the instruction to continue printing is given from the instruction unit, it is preferable that the cleaning control unit cause the cleaning unit to perform cleaning in the case where it is determined that the distance exceeds the threshold value, and the cleaning control unit cause the cleaning unit not to perform cleaning in the case where it is determined that the distance is equal to or less than the threshold value.

According to the aspect of the invention, the carriage position determination unit determines whether the distance from the end position of the carriage movement start position to the stopped carriage position (stopped position) at the time of the jam detection exceeds the threshold value in the printing medium. When the instruction to continue printing is given from the instruction unit after the jam is released, the cleaning control unit causes the cleaning unit to perform cleaning in the case where it is determined that the distance exceeds the threshold value, and the cleaning control unit causes the cleaning unit not to perform cleaning in the case where it is determined that the distance is equal to or less than the threshold value. In this manner, when the carriage has not moved much in the moving direction from the end of the printing medium, since there is a high probability that the printing medium may not be in contact with an ejection orifice (nozzle forming surface) of the liquid ejecting head to cause an ejection error, cleaning is not performed and thereby, wasteful cleaning is decreased.

According to another aspect of the invention, there is provided a printing apparatus including a driving unit that moves a carriage having a liquid ejecting head which ejects liquid to a printing medium; a cleaning unit that performs cleaning on the liquid ejecting head; a jam detecting unit that detects a jam of the printing medium; a direction determination unit that determines a moving direction of the carriage; a carriage control unit that controls the driving unit to move the carriage and withdraw the carriage in a reverse direction of the moving direction of the carriage at the time of the jam detection determined by the direction determination unit when the jam detecting unit detects the jam; a capping unit that is capable of capping the liquid ejecting head provided in one end in a movement path of the carriage; an instruction unit that is operated to give an instruction to continue printing after the jam is released; and a cleaning control unit that causes the cleaning unit to perform cleaning on the liquid ejecting head in the case where the carriage is withdrawn in a position opposite to the capping unit, and the cleaning control unit causes the cleaning unit not to perform cleaning on the liquid ejecting head in the case where the carriage is withdrawn in a position of the capping unit side, when the instruction to continue printing is given from the instruction unit.

According to the aspect of the invention, when the jam detecting unit detects a jam, a carriage control unit withdraws the carriage in a reverse direction of the moving direction of the carriage at the time of the jam detection determined by the direction determination unit. When the carriage is withdrawn in a position of the capping unit side, the liquid ejecting head is capped by the capping unit. When the instruction to continue printing is given from the instruction unit by the user who releases the jam, the cleaning control unit causes the cleaning unit to perform cleaning on the uncapped liquid ejecting head in the case where the carriage is withdrawn in a position opposite to the capping unit side. On the other hand, when the carriage is withdrawn in a position of the capping unit side, since the liquid ejecting head is capped, the cleaning control unit causes the cleaning unit not to perform cleaning on the liquid ejecting head. In other words, when the liquid in the ejection orifice (nozzle) does not easily dry by capping the liquid ejecting head and the occurrence frequency of the ejection error is low, cleaning is not performed and thereby, wasteful cleaning does not need to be performed.

It is preferable that the printing apparatus further include a time determination unit that determines whether a standby time of the carriage withdrawn in the position opposite to the capping unit is equal to or more than set time. It is preferable that the cleaning control unit cause the cleaning unit to perform cleaning on the liquid ejecting head when it is determined that the standby time is equal to or more than the set time by the time determination unit.

According to the aspect of the invention, when the time determination unit determines whether the standby time of the carriage withdrawn in the position opposite to the capping unit side is equal to or more than set time, the cleaning control unit causes the cleaning unit to perform cleaning on the liquid ejecting head. On the other hand, when the standby time is less than the set time, the cleaning control unit causes the cleaning unit not to perform cleaning on the liquid ejecting head. Therefore, wasteful cleaning does not need to be performed.

In the printing apparatus, it is preferable that the cleaning control unit cause the cleaning unit to perform a first cleaning in the case where it is determined that the standby time is equal to or more than a first set time and less than a second set time by the time determination unit, and the cleaning control unit cause the cleaning unit to perform a second cleaning stronger than the first cleaning in the case where it is determined that the standby time is equal to or more than the second set time.

According to the aspect of the invention, the cleaning control unit causes the cleaning unit to perform the first cleaning in the case where it is determined that the standby time is equal to or more than the first set time and less than the second set time by the time determination unit. In addition, the cleaning control unit causes the cleaning unit to perform a second cleaning stronger than the first cleaning in the case where it is determined that the standby time is equal to or more than the second set time.

According to still another aspect of the invention, there is provided a printing method which performs printing by ejecting liquid to a printing medium from a liquid ejecting head while a carriage reciprocates, the method including detecting a jam based on decreased moving speed of the carriage to a set speed or less which allows estimation of the occurrence of a jam of the printing medium; stopping the carriage movement when the jam is detected in the detecting of the jam; and causing the cleaning unit to perform cleaning on the liquid ejecting head when an instruction to continue printing is given from an instruction unit after the jam is released. According to the aspect of the invention, the same effects as the above printing apparatus can be obtained.

According to still another aspect of the invention, there is provided a printing method which performs printing by ejecting liquid to a printing medium from a liquid ejecting head while a carriage reciprocates, the method including detecting a jam of the printing medium; determining a moving direction of the carriage; withdrawing the carriage in a reverse direction of the moving direction of the carriage at the time of the jam detection determined in the determining of the moving direction when the jam is detected in the detecting of the jam; and causing a cleaning unit to perform cleaning on the liquid ejecting head in the case where the carriage is withdrawn in a position opposite to a capping unit that is capable of capping the liquid ejecting head provided in one end in a movement path of the carriage, and causing the cleaning unit not to perform cleaning on the liquid ejecting head in the case where the carriage is withdrawn in a position of the capping unit side, when an instruction to continue printing is given from an instruction unit after the jam is released. According to the aspect of the invention, the same effects as the above printing apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment according to the invention which is specified as an ink jet type printer which is a kind of printing apparatus will be described with reference to FIGS. 1 to 8.

Figure 1:
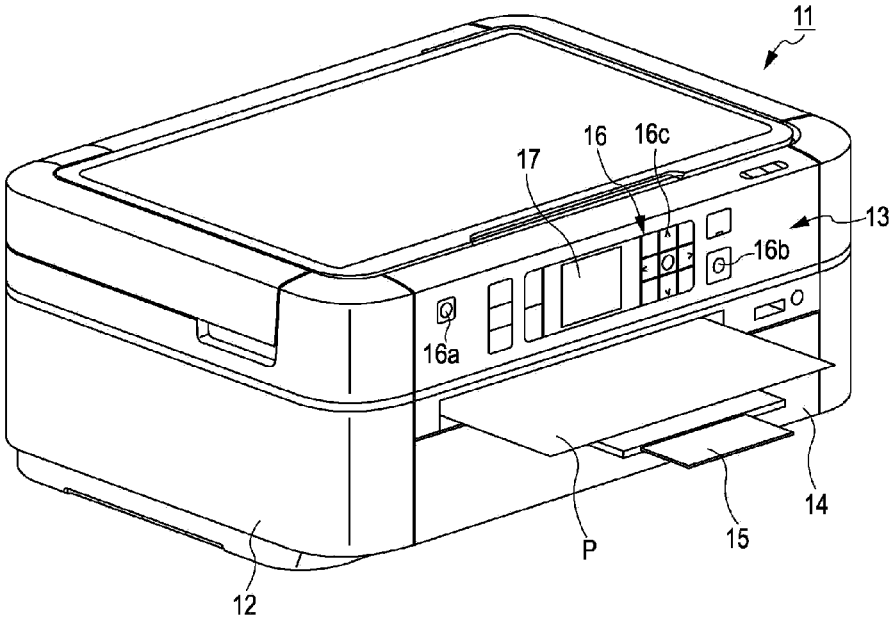
FIG. 1 is a perspective view of a printer according to a fist embodiment.

As shown in FIG. 1, the ink jet type printer (hereinafter, referred to as a "printer 11") includes a main body 12 of an approximately rectangular box shape. An operation panel 13 is provided in a front upper portion of the main body 12. A feeding cassette 14 capable of accommodating plural pieces of paper P is mounted in a lower side of the operation panel 13 in the main body 12 in an insertable and removable state. The printer 11 performs printing on the paper P fed from the feeding cassette 14 one sheet at a time and the paper P after the printing is discharged on a slide type paper discharge tray 15 provided in a central stage on the front surface of the main body 12.

The operation panel 13 includes an operating unit 16 for performing various operations on the printer 11 and a display unit 17 which displays various menus and images. A power switch 16*a*, a print start switch 16*b*, a selection switch 16*c* and the like are provided in the operation unit 16. For example, the when the printing is performed on the paper P, the print start switch 16*b* is pressed. In addition, it is possible to select various items in the menu displayed in the display unit 17 by operating the selection switch 16*c*. Moreover, when an error such as a paper jam occurs, the purport of the error is displayed on the display unit 17 and after a user removes the jammed paper P to release the paper jam, and operates one predetermined operation in the operation unit 16 as an example of an instruction unit to give an instruction to continue printing to the printer 11. Furthermore, performing manual cleaning is selected from maintenance system items displayed on the display unit 17 with the operation of the operation unit 16 so that the user can make the printer 11 perform cleaning by the manual operation.

Figure 2:
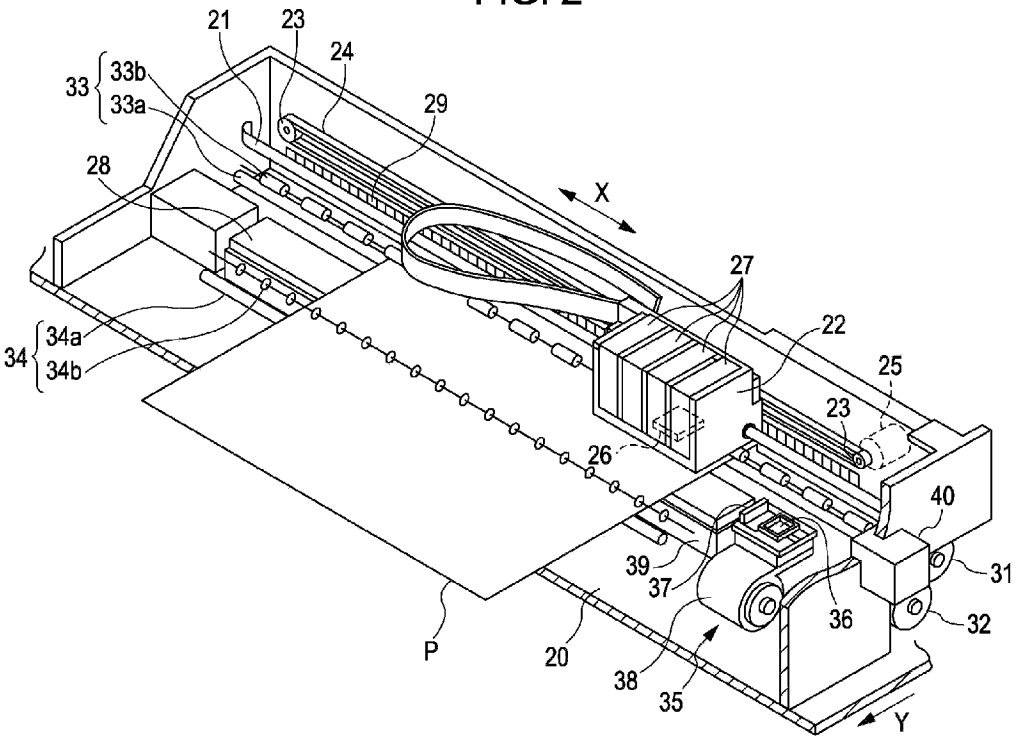
FIG. 2 is a perspective view showing a schematic configuration of the printer.

Next, the internal configuration of the printer 11 will be described. FIG. 2 shows the printer in a state of removal of an external housing. As shown in FIG. 2, in the printer 11, a guide shaft 21 having a predetermined length is installed between a left side wall and a right side wall in FIG. 2 of a main frame 20 of an approximately rectangular box shape in which an upper side and a front side are opened and a carriage 22 is provided to reciprocate in a main scanning direction X along the guide shaft 21. The carriage 22 is fixed to an endless timing belt 24 which is wound in a pair of pulleys 23 which is installed on an inner surface of a rear plate of the main body frame 20. A carriage motor 25 having a driving shaft which is installed in the right side pulley 23 in FIG. 2 as an example of a driving unit is driven forwardly and reversely and the timing belt 24 forwardly and reversely rotates so that the carriage 22 reciprocates in the main scanning direction X.

An ink jet type printing head 26 is provided in a lower portion of the carriage 22 as an example of a liquid ejecting head. Plural nozzles which eject ink are opened on a lower surface of the printing head 26. Further, plural ink cartridges 27 are mounted on an upper portion of the carriage 22. The ink cartridge 27 respectively contains four colors of ink, for example, black (K), cyan (C), magenta (M) and yellow (Y). The ink colors are not limited to the four colors, and may be three colors or five to eight colors. The printing head 26 ejects ink supplied from each ink cartridge 27 from the nozzles of the respective colors.

In a lower position opposite to the printing head 26, a supporting plate 28 which defines gaps between the printing head 26 and the paper P is provided. The supporting plate 28 extends in the width direction (in the X direction in FIG. 2) over a range including a printing region in which printing is performed by the printing head 26. During the printing, ink ejected from the printing head 26 is landed in a place on the supporting plate 28 of the paper P.

Further, a linear encoder 29 which outputs a number of pulses proportional to the amount of movement of the carriage 22 is provided to extend along the guide shaft 21 in a rear surface side of the carriage 22.

In addition, a feeding motor 31 and a transporting motor 32 are provided in a right lower portion of the main body frame 20 in FIG. 2. A feeding roller (for example, a pickup roller, not shown) which feeds the plural pieces of paper P set in the feeding cassette 14 one sheet at a time is driven by the feeding motor 31.

A pair of transporting rollers 33 and a pair of discharging rollers 34 are respectively arranged on the upstream side and the downstream side of a transporting direction Y (a sub-scanning direction) with interposing of the supporting plate 28. The pair of transporting rollers 33 includes a transport driving roller 33*a* which is driven to rotate by power of the transporting motor 32 and a transport driven roller 33*b* which rotates in contact with the transport driving roller 33*a*. Moreover, the pair of discharging rollers 34 includes a discharge driving roller 34*a* which is driven to rotate by power of the transporting motor 32 and a discharge driven roller 34*b* which rotates in contact with the discharge driving roller 34*a*. As the transporting motor 32 is rotatably driven, the transport driving roller 33*a* and the discharge driving roller 34*a* are driven, and the paper P is transported in the sub-scanning direction Y in the state of being interposed (nipped) between both pairs of rollers 33 and 34. In the embodiment, an example of a transporting unit includes the transporting motor 32, the pair of transporting rollers 33 (transporting rollers in the upstream side) and the pair of discharging rollers 34 (transporting rollers in the downstream side).

As shown in FIG. 2, a printing operation which ejects ink to the paper P from the nozzles of the printing head 26 while the carriage 22 reciprocates in the main scanning direction X, and a feeding operation which transports the paper P in the sub-scanning direction Y by a predetermined transporting amount, are alternately repeated, thereby performing printing of documents, images or the like on the paper P.

In FIG. 2, an end position (right end position in FIG. 2) on a movement path of the carriage 22 is a home position. A maintenance apparatus 35 which performs maintenance including cleaning with respect to the printing head 26 is installed under the carriage 22 arranged in the home position as an example of a cleaning unit. The maintenance apparatus 35 includes a cap 36, a wiper 37, a suction pump 38 and the like and performs cleaning by driving the suction pump 38 and forcibly sucking and discharging the ink from the nozzles of the printing head 26 in a state where the cap 36 comes into contact with a nozzle forming surface 26*a* of the printing head 26 arranged in the home position. Waste ink which is sucked and discharged from the nozzles of the printing head 26 by the maintenance apparatus 35 is discharged to a waste liquid tank 39 arranged in the lower side of the supporting plate 28.

In the embodiment, the transporting motor 32 is a common power source for the maintenance apparatus 35 as well as the transport driving roller 33*a* and the discharge driving roller 34*a*. When the carriage 22 is arranged in a switching position adjacent to the home position, connection of a power transmission switching apparatus 40 is cut off and the transporting motor 32 is driven in the cut off state to select a connection target (switching target) to output power. The carriage 22 is withdrawn in the printing region from the switching position, and then, the power transmission switching apparatus 40 is connected to the selected connection target.

Figure 3:
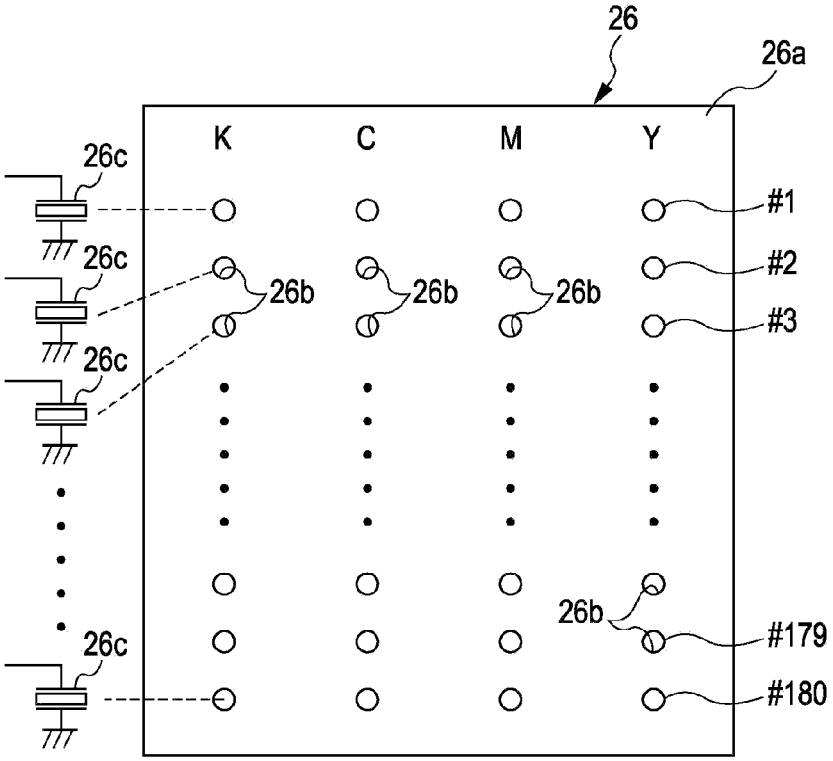
FIG. 3 is a schematic bottom view of a printing head.

As shown in FIG. 3, 180 nozzles #1 to #180 in total arranged at a predetermined nozzle pitch are arranged in 4 rows in the sub-scanning direction (the vertical direction in FIG. 2) and a total of 4 rows of nozzles 26*b* of black (K), cyan (C), magenta (M) and yellow (Y) are formed on the nozzle forming surface 26*a* of the printing head 26. In the example, the printing with four colors of K, C, M and Y is performed by using 4 rows of nozzles 26*b*. Each of the nozzles 26*b* configuring the nozzle rows may be arranged in zigzags.

As shown in FIG. 3, a discharge driving element 26*c* (ejection driving element) for ejecting the ink from the nozzle 26*b* is provided in every nozzle 26*b* in the printing head 26 (however, nozzles only for one row are schematically drawn outside of the printing head 26 in FIG. 3). The discharge driving element 26*c* is made of, for example, a piezoelectric vibrating element or an electrostatic driving element and, when a voltage pulse of a predetermined driving waveform is applied, an inner wall portion (vibrating plate) of an ink chamber which communicates with the nozzle 26*b* is vibrated by an electrostriction action or an electrostatic driving action to expand or compress the ink chamber, thereby ejecting ink drops from the nozzle 26*b*. The discharge driving element 26*c* may be a heater which heats the ink in a nozzle path and may adopt a method of discharging the ink drops from the nozzle using the expansion of bubbles generated due to the vaporization of the ink heated by the heater.

Figure 4:
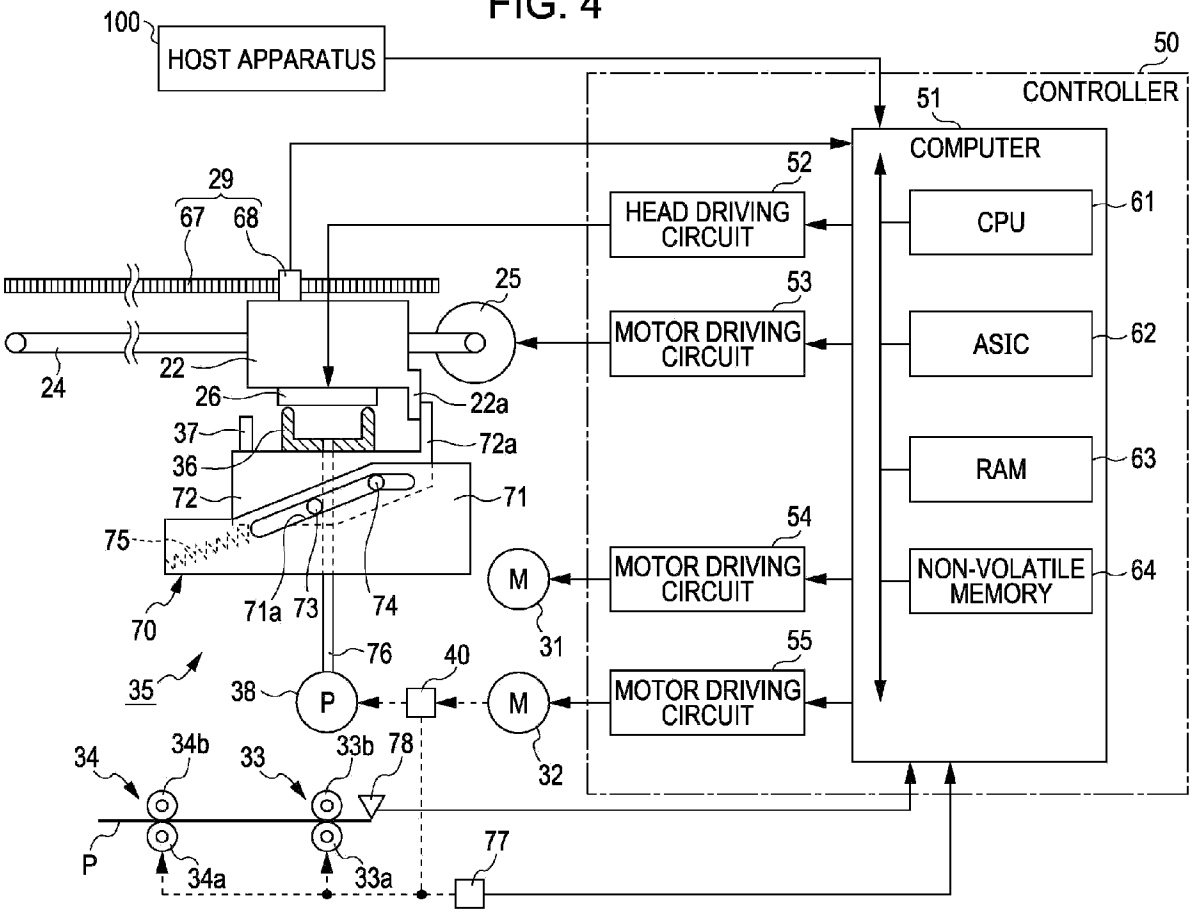
FIG. 4 is a schematic view showing an electrical configuration of the printer and a lifting mechanism of a maintenance apparatus.

FIG. 4 is a block diagram showing an electrical configuration of a recording apparatus. Hereafter, the electrical configuration of the printer 11 will be described based on the FIG. 4.

As shown in FIG. 4, the printer 11 includes a controller 50. The controller 50 includes a computer 51, a head driving circuit 52, and motor driving circuits 53 to 55. The computer 51 includes a CPU 61, an ASIC 62, a RAM 63 and a non-volatile memory 64.

Figure 8:
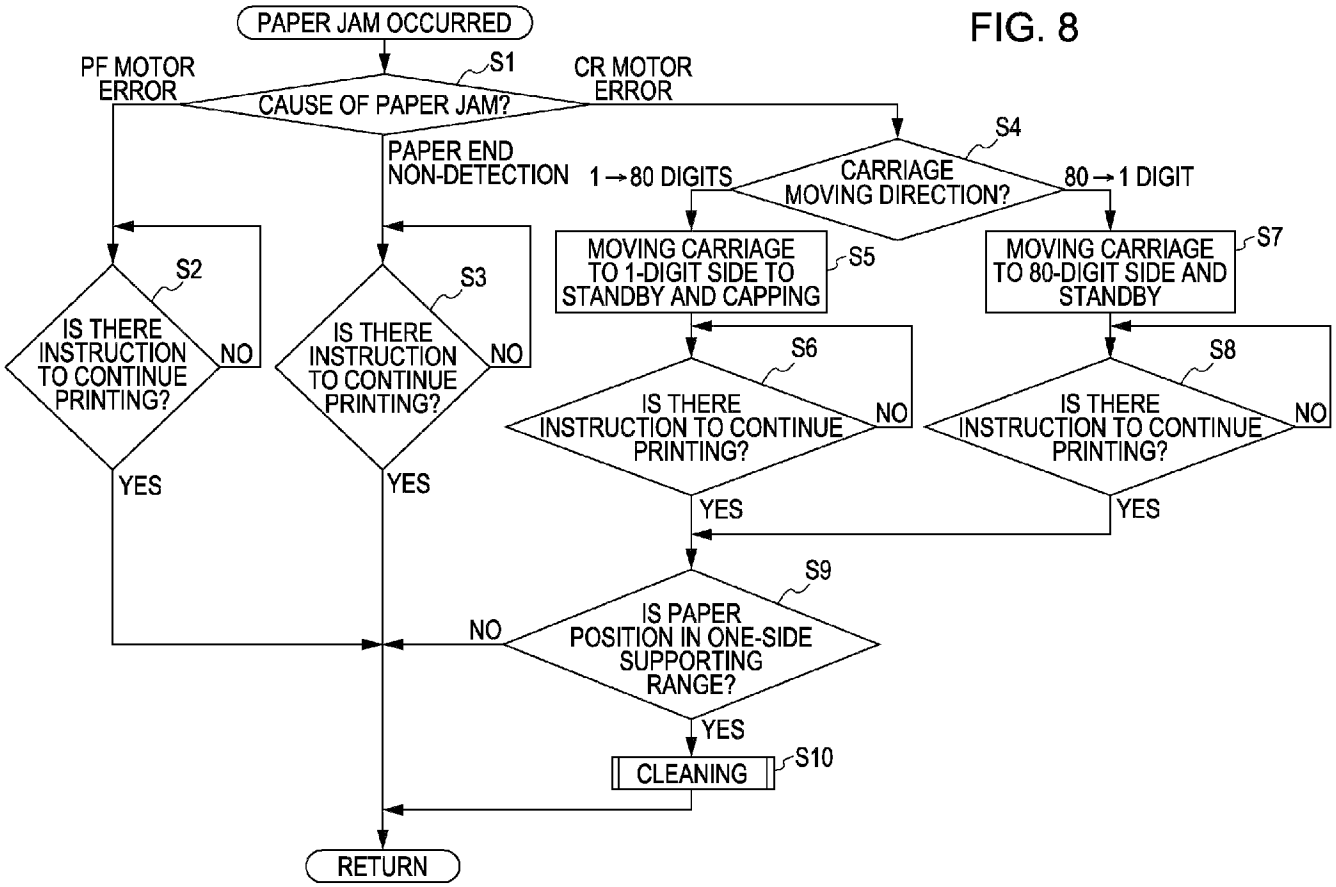
FIG. 8 is a flow chart showing control when a paper jam occurs.

A program shown a flow chart of FIG. 8 is stored in the non-volatile memory 64. In addition, various control programs to drive and control the printing head 26, the carriage motor 25 and the transporting motor 32 are stored in the non-volatile memory 64. In the RAM 63, the calculation result of the CPU 61 is temporarily stored or print data and development data which develops the print data are temporarily stored.

The CPU 61 is connected to the printing head 26 through the head driving circuit 52. The CPU 61 applies a discharge driving pulse (voltage pulse) to the discharge driving element 26*c* provided in every nozzle 26*b* of the printing head 26 by outputting bitmap data obtained by developing the print data received from a host apparatus 100 and an ejection control signal to a head driving circuit 52. The discharge driving element 26*c* (for example, vibrating element) ejects the ink drops from the nozzle 26*b* by giving the vibration according to the applied discharge driving pulse to the ink chamber which is communicated with the nozzle 26*b* and expanding and compressing the ink chamber.

The CPU 61 is connected to the carriage motor 25 through the motor driving circuit 53 and drives and controls the carriage motor 25 by outputting a drive command signal to the motor driving circuit 53. Moreover, the CPU 61 is connected to the feeding motor 31 through the motor driving circuit 54 and drives and controls the feeding motor 31 by outputting a drive command signal to the motor driving circuit 54. In addition, the CPU 61 is connected to the transporting motor 32 through the motor driving circuit 55 and drives and controls the transporting motor 32 by outputting a drive command signal to the motor driving circuit 55. For example, by the forward rotational driving of the feeding motor 31 and the transporting motor 32, the feeding roller (not shown), the transport driving roller 33*a* and the discharge driving roller 34*a* are rotatably driven so that the feeding, the transporting (paper feeding) and the discharging (paper discharge) of the paper P are performed and the suction pump 38 is in a released state at this time. On the other hand, the suction pump 38 performs pumping by reversely driving the transporting motor 32.

When a cleaning condition is established, the CPU 61 causes the maintenance apparatus 35 to automatically perform cleaning (ink suction operation). When the cleaning is performed, the CPU 61 causes the transporting motor 32 to reversely drive by outputting a reverse driving signal to the motor driving circuit 55 in a state where the carriage 22 is in the home position, and causes the suction pump 38 to perform pumping. Further, when an operation signal from a switch to instruct manual cleaning in the operation unit 16 is input, the CPU 61 performs cleaning. In a state where the cap 36 is in contact (capping) with the nozzle forming surface 26*b* of the printing head 26, when the suction pump 38 is driven, suction force acts through a tube 76 in the cap 36, and the ink is forcibly sucked and discharged from the nozzle 26*b* due to the suction force (negative pressure).

The linear encoder 29 has a function of, for example, optically detecting the movement position of the carriage 22 and includes a slit tape 67 which is stretched along the track of the carriage 22 and a sensor 68 which detects plural optical slits formed on the slit tape 67. The linear encoder 29 outputs a detection signal (pulse signal) with the number of pulses corresponding to the number of intermissions of light passing through the respective slits according to the scanning of the carriage 22. The CPU 61 recognizes the moving direction of the carriage 22 by comparing the phases of two kinds of pulse signals (A phase and B phase) included in the detection signal from the linear encoder 29. Then, the CPU 61 detects the moving position from the original position of the carriage 22 (for example, the home position) based on a counted value obtained by counting of a counter (not shown) provided in the CPU such that the number of pulses corresponding to the number of light intermissions is incremented, for example, when the carriage is forwardly moved, and the number of pulses corresponding to the number of light intermissions is decremented when the carriage is reversely moved. The CPU 61 performs position control and speed control of the carriage 22 on the basis of the counted value thereof. That is, the speed control is performed such that the driving signal instructing the speed according to the moving position of the carriage 22 is output to the motor driving circuit 53 to drive and control the carriage motor 25. The computer 51 generates an ejection timing signal of the ink drops ejected from the nozzle 26*b* of the printing head 26 based on the detection signal (pulse signal) from the linear encoder 29 and outputs the signal to the head driving circuit 52 to control the ejection timing in which the ink drops are ejected from the nozzle 26*b* of the printing head 26.

The maintenance apparatus 35 includes a lifting apparatus 70 to lift the cap 36. The lifting apparatus 70 is, for example, a slide type apparatus having the structure shown in FIG. 4 in the embodiment. In other words, the lifting apparatus 70 includes a frame 71 of an approximately box shape in which an upper side is opened and a slider 72 slidably supported along a path inclined with respect to the frame 71, and the cap 36 and the wiper 37 are supported on an upper surface of the slider 72. Two pairs of guide pins 73 and 74 protruding from both side surfaces of the slider 72 are movably inserted into inclined guide holes 71*a* formed in the frame 71. Further, the slider 72 is biased by a tension spring 75 in a downward direction. In the slider 72, an engaging lever 72*a* which can be engaged with an engaging unit 22*a* extending in a downward direction from the carriage 22 upwardly protrudes. As the engaging unit 22*a* presses the engaging lever 72*a* in the main scanning direction X (the right direction in FIG. 4) in the middle of returning of the carriage 22 to the home position, the guide pins 73 and 74 are guided along the inclined guide holes 71*a* so that the slider 72 slides in the right direction with respect to the frame 71 in the FIG. 4 while being elevated. Meanwhile, when the carriage 22 is moved to the printing region from the home position and the engaging unit 22*a* is separated from the engaging lever 72*a*, the slider 72 slides in the left direction in FIG. 4 due to biased force of the tension spring 75 while falling. By elevating or falling of the slider 72, the cap 36 is elevated when the carriage 22 is returned to the home position and the cap 36 falls when the carriage 22 is separated from the home position. In the embodiment, an example of a capping unit includes the cap 36 and the lifting apparatus 70.

The rotation of the transporting motor 32 is detected by a rotary encoder 77 and the pulse signal is output to the computer 51 from the rotary encoder 77. The computer 51 includes a counter (not shown) which counts, for example, the pulse edge of the pulse signal input from the rotary encoder 77 and recognizes a transporting position of the paper based on the counted value of the counter. A paper detector 78 which detects a tip end and a rear end of the paper P is provided in the position of the upstream side of the transporting direction Y from the pair of transporting rollers 33. In the carriage 22, a paper width sensor 79 (refer to FIG. 5) capable of detecting a paper end of the paper P in the width direction (main scanning direction X) is provided.

Figure 5:
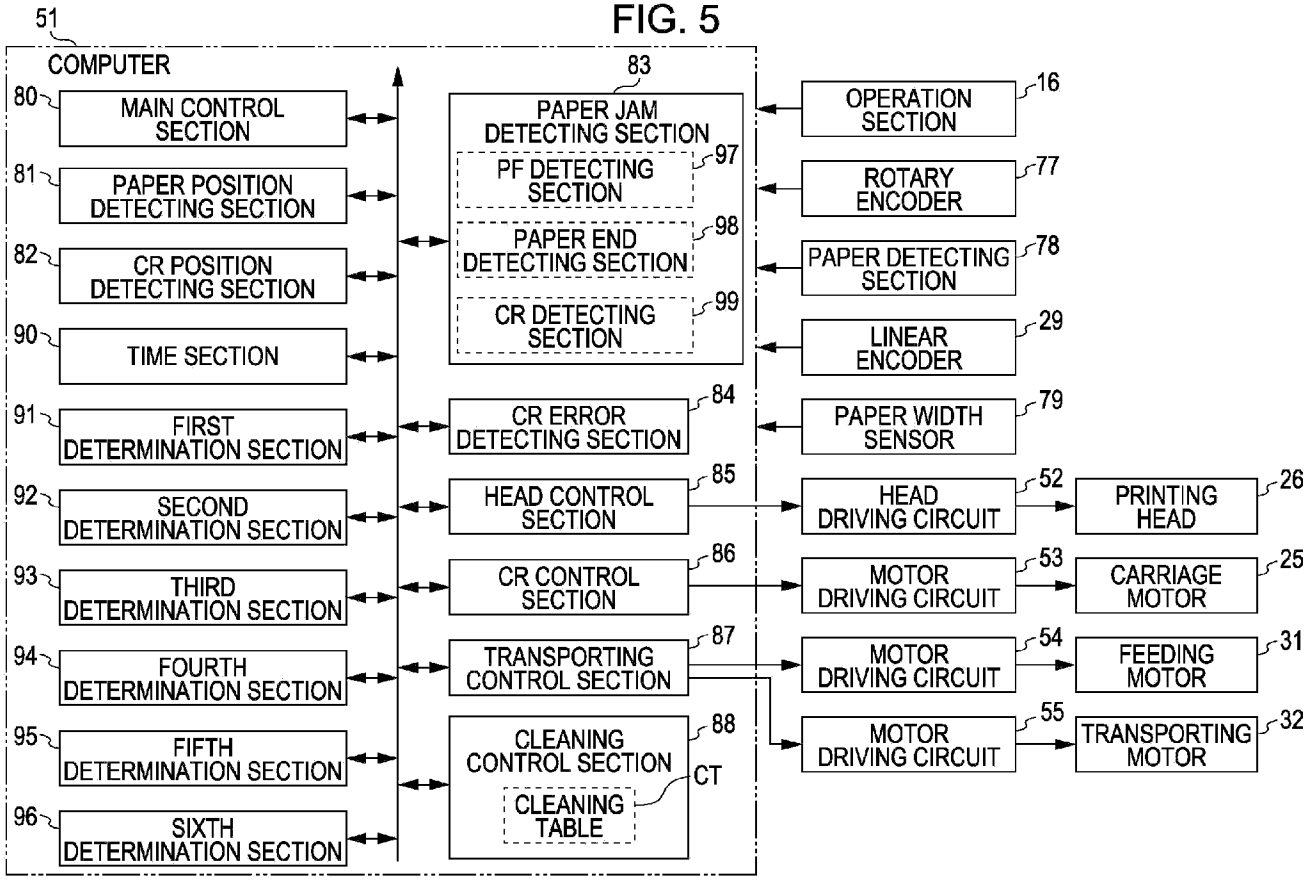
FIG. 5 is a block diagram showing a functional configuration of a computer.

FIG. 5 shows functional blocks built in the computer 51 by causing the CPU 61 to execute a program stored in the non-volatile memory 64 in the computer 51. As shown in FIG. 5, the computer 51 includes a main control section 80, a paper position detecting section 81, a carriage position detecting section 82 (hereafter, also referred to as "CR position detecting section 82"), a jam detecting section 83, a carriage error detecting section 84 (also referred to as "CR error detecting section 84"), a head control section 85, a carriage control section 86 (also referred to as "CR control section 86"), a transporting control section 87 and a cleaning control section 88. In the embodiment, an example of a carriage position detecting unit includes the CR position detecting section 82, an example of a jam detecting unit includes the jam detecting section 83 and an example of a cleaning control unit includes the cleaning control section 88.

The main control section 80 performs various controls on the transportation system, the printing system, the cleaning system, the error control system and the like in the printer 11 overall.

The paper position detecting section 81 detects the position of the paper P in the transporting direction Y (transporting position) during the printing. When the tip end of the fed paper P is detected by the paper detector 78 and transported by a predetermined amount from the detected position to reach a reference position (for example, a position opposite to the uppermost stream nozzle of the printing head 26), the counted value of the counter is reset. Then, the paper position detecting section 81 sets a point of time when the tip end of the paper P reaches the reference position as the origin (counted value "0") and counts the number of edges in the pulse signal input from the rotary encoder 77 to obtain the transporting position of the paper P from the counted value.

The CR position detecting section 82 detects the moving position of carriage 22. The CR position detecting section 82 compares the pulse signals of A phase and B phase input from the linear encoder 29 to recognize the moving direction of the carriage 22. Then, whenever the CR position detecting section 82 detects the edge of the pulse signal from the linear encoder 29, for example, when the carriage is forwardly moved, the CR position detecting section 82 increments the reset counted value of the counter (not shown) at the time of being the carriage 22 in the original position (for example, in the home position) and decrements the reset counted value when the carriage is reversely moved. The CR position detecting section 82 detects the moving position with respect to the original position of the carriage 22 based on the obtained counted value.

The jam detecting section 83 detects a paper jam. The jam detecting section 83 includes a PF detecting section 97, a paper end detecting section 98 and a CR detecting section 99 as an example of a detecting unit as shown in FIG. 5.

The PF detecting section 97 detects the load (torque) of the transporting motor 32 and detects a paper jam by an occurrence of a PF motor error in which the detected torque exceeds a predetermined value.

The paper end detecting section 98 detects a paper jam with a paper end non-detection in which the tip end of the paper P is not detected by the paper detector 78, irrespective of the feeding motor 31 being driven by a rotation amount according to a predetermined feeding amount of a place in which the tip end of the fed paper P can sufficiently reach a detection region of the paper detector 78.

The CR detecting section 99 detects the moving speed of the carriage 22 and detects a paper jam based on the fact that the moving speed of the carriage 22 exceeds a predetermined reduced speed corresponding to the lowest load considered as paper jam occurrence, is decreased from the normal speed and becomes equal to or less than a set speed. An edge period (inverse number of the carriage speed) of the pulse signal from the linear encoder 29 is timed to obtain the moving speed of the carriage 22 from the timed edge period.

The CR error detecting section 84 detects the load (for example, torque) of the carriage motor 25 and detects an error of the carriage 22 based on the load exceeding a load threshold in which the carriage 22 can be considered to be touched by a foreign object. In the embodiment, the paper jam which occurs due to the contact of the carriage 22 or the printing head 26 which reciprocates in the main scanning direction X with the paper P is detected due to the decrease in the speed of the carriage 22 (that is, the rotation speed of the carriage motor 25) by the CR detecting section 99 in an early stage and an error when the carriage 22 is touched by a foreign object on the moving path is detected by the change in the torque of the carriage motor 25.

The head control section 85 controls the printing head 26 through the head driving circuit 52. For details, the head control section 85 perform ink ejection control of the printing head 26 by outputting a print image data and an ejection control data included in the printing data to the head driving circuit 52 according to the instruction of the main control section 80, after converting to a format that the head driving circuit 52 handles.

The CR control section 86 controls the carriage motor 25 through the motor driving circuit 53. For details, the CR control section 86 performs position control and speed control of the carriage 22 in the main scanning direction X by sequentially outputting a speed command value (for example) according to the moving position of the carriage 22 based on a carriage speed table stored in the non-volatile memory 64 to the motor driving circuit 53.

The transporting control section 87 controls the feeding motor 31 through the motor driving circuit 54 and controls the transporting motor 32 through the motor driving circuit 55 to perform the feeding of the paper P and controls the transporting motor 32 to perform the transporting (paper feeding) and discharging (paper discharge) of the paper P.

The cleaning control section 88 performs cleaning on the printing head 26 when a predetermined condition for performing cleaning such as predetermined cleaning time is established or when performing of the manual cleaning is instructed by operating the operation unit 16. The cleaning control section 88 performs cleaning on the nozzle forming surface **26*a* of the printing head 26 in the capping state in which the cap 36 is in contact with the nozzle forming surface 26*a* of the printing head 26 to control the carriage motor 25 for the capping. Further, the cleaning control section 88 drives and controls the transporting motor 32 to drive the suction pump 38 to give the suction pressure (negative pressure) to the inside of the cap 36 in a state where the cap 36 is in contact with the nozzle forming surface 26*a* of the printing head 26. When the carriage 22 is arranged in a cleaning position (home position), the power transmission switching apparatus 40 can switch the cleaning position to the switching position in which the power of the transporting motor 32 can be transmitted to the suction pump 38**.

The computer 51 further includes a time section 90, a first determination section 91, a second determination section 92 as an example of a direction determination unit, a third determination section 93, a fourth determination section 94 as an example of a determination unit, a fifth determination section 95 and a sixth determination section 96.

The time section 90 times various elapsed times necessary for control.

When a paper jam is detected, the first determination section 91 determines a cause of the detected paper jam. In other words, the first determination section 91 determines whether the paper jam detected by the jam detecting section 83 is the PF motor error detected by the PF detecting section 97, the paper end non-detection detected by the paper end detecting section 98 or the CR motor error detected by the CR detecting section 99.

The second determination section 92 determines the moving direction of the carriage 22 when the paper jam occurs. In other words, the second determination section 92 determines whether the moving direction of the carriage 22 is a direction from a 1-digit side to a 80-digit side (forward moving direction) or a direction from the 80-digit side to the 1-digit side (reverse moving direction) when the paper jam occurs.

The third determination section 93 determines whether there is an instruction to continue printing by operating the operation unit 16 to continue (restart) the printing after a user releases the paper jam.

The fourth determination section 94 determines a paper position, that is, whether the transporting position y of the paper P is in the both-side supporting range in which the paper P is supported in two places of the pair of transporting rollers 33 in the upstream side of the transporting direction Y with respect to the moving path of the printing head 26 and the pair of discharging rollers 34 in the downstream side of the transporting direction, or in the one-side supporting range supported by only one of the pair of transporting rollers 33 and the pair of discharging rollers 34. In the embodiment, when the third determination section 93 determines that the instruction to continue printing is received, the fourth determination section 94 determines the paper position. However, this determination may be performed in a period from the time of detecting paper jam to the time of receiving the instruction to continue printing.

The fifth determination section 95 determines whether the carriage 22 stopped at the time of the paper jam detection is positioned toward a carriage movement target by a set distance LX or more from an end of the paper P at a carriage activating position. Since the fifth determination section 95 is used in a second embodiment which will be described later, the description thereof will be described in the second embodiment.

The sixth determination section 96 determines whether a standby time of the carriage 22 which stands by at the position of the 80-digit side at the time of the paper jam detection is equal to or more than a set time. The sixth determination section 96 is used in a third embodiment described later, the description thereof will be described in the third embodiment.

Figure 6:
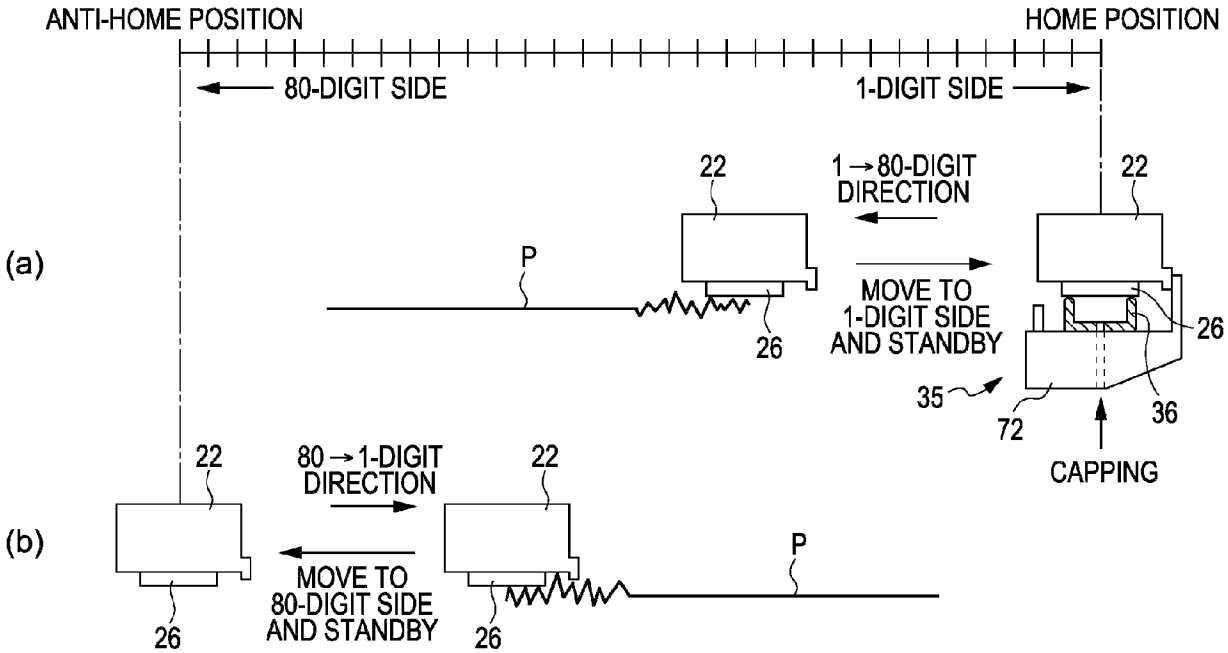
FIG. 6 is a schematic view describing carriage control at the time of a paper jam detection.

As shown in FIG. 6, the carriage 22 can reciprocate on the moving path from the 1-digit side (home position) to the 80-digit side (anti-home position). When the paper P is in a moving area of the carriage 22, as shown in FIG. 6, the carriage 22 or the printing head 26 is in contact with the side end of the paper P so that a paper jam occurs in some cases.

In the embodiment, after the paper jam occurs, the carriage 22 is moved in the reverse direction of the moving direction when the paper jam occurs to stand by at an end position on the moving path. In other words, as shown in (a) of FIG. 6, when the moving direction of the carriage 22 when the paper jam occurs (paper jam detection direction) is the direction from the 1-digit side to the 80-digit side, the carriage 22 stopped when the paper jam occurs is moved to the 1-digit side to stand by at the home position of the 1-digit side. Meanwhile, when the moving direction of the carriage 22 when the paper jam occurs (paper jam detection direction) is the direction from the 80-digit side to the 1-digit side, the carriage 22 stopped when the paper jam occurs is moved to the 80-digit side to stand by at the anti-home position of the 80-digit side.

Figure 7A:
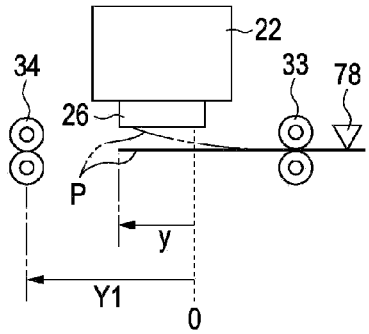
FIG. 7A is a schematic side view showing when a transporting position of paper is in a one-side supporting range and FIG. 7B is a schematic side view showing when a transporting position of paper is in a both-side supporting range, respectively.
Figure 7B:
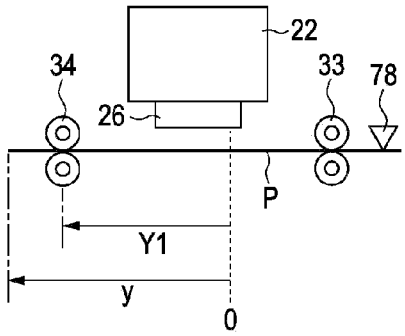

In transporting processes of the paper P, there are the both-side supporting range in which the paper P is supported (interposed) in two places of the pair of transporting rollers 33 and the pair of discharging rollers 34 in the transporting direction as shown in FIG. 7A and the one-side supporting range in which the paper P is supported (interposed) in one place by only one of the pair of transporting rollers 33 and the pair of discharging rollers 34 as shown in FIG. 7B. In the embodiment, the paper position when the tip end of the paper P reaches the reference position (for example, the position opposite to the uppermost stream nozzle of the printing head 26) is set as the origin "0", the counted value in which a transporting distance is counted from the origin is set as the transporting position y of the paper P.

As shown in FIG. 7A, the transporting position y is in the one-side supporting range until the transporting position y reaches a transporting position Y1 when the tip end of the paper P reaches the pair of discharging rollers 34. Then, the transporting position y is in the one-side supporting range again as the transporting position y reaches a transporting position Y2 when the rear end of the paper P reaches the pair of transporting rollers 33. In other words, when the transporting position y is in the one-side supporting range ($y \leq Y1$, $y \geq Y2$), the paper P is supported in one place.

On the other hand, as shown in FIG. 7B, the transporting position y is in the both-side supporting range as the transporting position y exceeds the transporting position Y1 when the tip end of the paper P reaches the pair of discharging rollers 34. Then, the transporting position y is in the both-side supporting range again as the transporting position y exceeds the transporting position Y2 when the rear end of the paper P reaches the pair of transporting rollers 33. In other words, when the transporting position y is in the both-side supporting range ($Y1 < y < Y2$), the paper P is supported in two places.

As shown in FIG. 7B, when the transporting position y is in the both-side supporting range in which the paper P is interposed between two places of both sides in which the moving area of the carriage 22 is interposed in the transporting direction Y, since the end of the paper P does not rise, it is possible to consider that a paper jam caused by interference with the carriage 22 or the printing head 26 does not occur. Meanwhile, as shown in FIG. 7A, when the transporting position y is in the one-side supporting range in which the paper P is supported in only one side of both sides in which the moving area of the carriage 22 is interposed in the transporting direction Y, since there is a possibility that the end of the paper P may rise as indicated by a two-dot chain line in the same drawing, a paper jam caused by interference with the carriage 22 or the printing head 26 can occur. For this reason, when the CR detecting section 99 detects the paper jam caused by the CR motor error in the jam detecting section 83, as the fourth determination section 94 determines that the transporting position y is in the one-side supporting range ($y \leq Y1$, $y \geq Y2$), there is a high probability of the paper jam. However, when it is determined that the transporting position y is in the both-side supporting range ($Y1 < y < Y2$), there is a high probability of there being no paper jam.

Operations

Hereafter, the control when the paper jam occurs in the printer 11 will be described according to the flow chart shown in FIG. 8.

The paper jam occurring during the operation of the printer 11 is detected by the jam detecting section 83. When the paper jam is detected, the control shown in the flow chart in FIG. 8 is performed.

In Step S1, the cause of the paper jam is determined. This determination is performed by the first determination section 91. That is, any one of three detecting sections 97 to 99 included in the jam detecting section 83 determines whether the paper jam is detected. For details, any one of three detecting sections 97 to 99 determines which of the PF motor error detected by the PF detecting section 97, the paper end non-detection error (paper jam error) detected by the paper end detecting section 98 and the CR motor error detected by the CR detecting section 99 is the cause of the paper jam. When it is determined that the PF motor error is the cause of the paper jam, the process proceeds to Step S2, and when it is determined that the paper end non-detection error is the cause of the paper jam, the process proceeds to Step S3. In addition, when it is determined that the CR motor error is the cause of the paper jam, the process proceeds to Step S4.

In Steps S2 and S3, it is determined whether there is the instruction to continue printing. When there is no instruction to continue printing, the carriage stands by until the instruction is given and when there is the instruction to continue printing, the carriage completes the routine. In this case, for example, the next sheet of paper P is fed to continue printing which has failed due to the paper jam according to the instruction to continue printing.

In Step S4, the moving direction of the carriage when the paper jam occurs is determined. When the moving direction of the carriage is the direction from the 1-digit side to the 80-digit side (forward moving direction), the process proceeds to Step S5, and when the moving direction of the carriage is the direction from the 80-digit side to the 1-digit side (reverse moving direction), the process proceeds to Step S7.

In Step S5, the carriage 22 is reversely moved to the 1-digit side to stand by at the home position. At this time, the cap 36 elevated according to the movement of the carriage 22 to the home position is in contact with the nozzle forming surface 26*a* of the printing head 26, and the printing head 26 is capped.

In Step S6, it is determined whether there is the instruction to continue printing. When there is no instruction to continue printing, the carriage stands by until the instruction is given and when there is the instruction to continue printing, the process proceeds to Step S9.

On the other hand, in Step S7, the carriage 22 is reversely moved to the 80-digit side to stand by at the anti-home position. In the anti-home position, the printing head 26 is not capped.

In Step S8, it is determined whether there is the instruction to continue printing. When there is no instruction to continue printing, the carriage stands by until the instruction is given and when there is the instruction to continue printing, the process proceeds to Step S9.

In Step S9, it is determined whether the paper position is in the one-side supporting range. When the paper position is in the one-side supporting range, the process proceeds to Step S10. On the other hand, when the paper position is not in the one-side supporting range, that is, in the both-side supporting range, the carriage completes the routine.

In Step S10, cleaning is performed. In other words, when the paper jam caused by the CR motor error is detected, as long as the paper position (transporting position y) at the time of the paper jam detection is in the one-side supporting range ($y \leq Y1$, $y \geq Y2$), cleaning is performed. Then, when the cleaning is finished, for example, the next paper P is fed and the printing which has failed due to the paper jam is started.

In this manner, the paper jam occurring due to the contact of the carriage 22 or the printing head 26 with the paper P is detected based on the fact that the carriage speed is decreased by as much as a load due to the paper jam from the normal speed and becomes lower than the set speed in the embodiment, and when this kind of paper jam is detected, as long as the paper P is in the one-side supporting range, cleaning is performed. Due to this, when the nozzle forming surface 26*a* of the printing head 26 is in contact with the paper P which becomes a paper jam, even when a meniscus of ink in the nozzle 26*b* is destroyed, the ink in the nozzle 26*b* is absorbed into the paper P, or bubbles in the nozzle 26*b* are mixed in, the nozzle 26*b* is filled with the ink of an appropriate amount in which the meniscus is adjusted by the cleaning after that time. As a result, ink drops having a proper size can be ejected from the nozzle without an ejection error. Therefore, printing with high quality can be realized.

As described above, according to the first embodiment, the following effects can be obtained.

(1) In the middle of moving the carriage 22 to the main scanning direction X, the paper jam caused by the contact with the paper P is detected and when this kind of paper jam is detected, cleaning is performed. Therefore, the ink ejection error is decreased in the first printing after releasing the paper jam and printing with high quality can be realized. Moreover, when the paper jam caused by the PF motor error or the paper end non-detection error is detected, since there is a high probability that the paper P may not be in contact with the nozzle forming surface 26*a* of the printing head 26 due to the paper jam during the feeding, the paper jam during the discharging and the like, cleaning is not performed. For this reason, when the paper jam occurs, unnecessary cleaning is not performed while necessary cleaning is performed so that the used amount of ink due to the cleaning can be suppressed.

(2) The paper jam caused by interference of the carriage 22 or the printing head 26 with the paper P is detected based on the fact that the moving speed of the carriage 22 is decreased to the set speed or less in which the moving speed is decreased by as much as a predetermined value corresponding to the lowest load when the paper jam occurs from the normal speed. Therefore, since the carriage 22 just interferes with a foreign object in the moving path, a CR error not having a negative influence on the nozzle 26*b* can be distinguished and only the paper jam which needs cleaning can be appropriately detected. Therefore, in case of an error in which, when the carriage 22 cannot move with causes other than the paper jam, it is possible to avoid performing wasteful cleaning regardless of the fact that there is no concern for ejection error.

(3) When the velocity anomaly of the carriage 22 is caused by the paper jam caused by the detected CR motor error, the transporting position y of the paper P at the time of the paper jam occurrence is checked and when the transporting position y is in the one-side supporting range in which the paper P is supported by only one of the pair of transporting rollers 33 and the pair of discharging rollers 34, cleaning is performed. Therefore, when the transporting position y is in the both-side supporting range in which the paper P is supported by both of the pair of transporting rollers 33 and the pair of discharging rollers 34 and there is a high probability of there being no jams, cleaning is not performed so that wasteful cleaning can be avoided as much as possible. For this reason, for example, as much as possible, the used amount of ink by the cleaning does not need to be increased.

Second Embodiment

Next, the second embodiment will be described using FIGS. 9 to 11. The second embodiment is different from the first embodiment in that the carriage control which determines whether cleaning is performed according to the position of the carriage 22 stopped when the paper jam is detected is performed. Since the configuration of the printer 11 is basically the same as the configuration of the first embodiment, only the particularly different configuration will be described.

Figure 9:
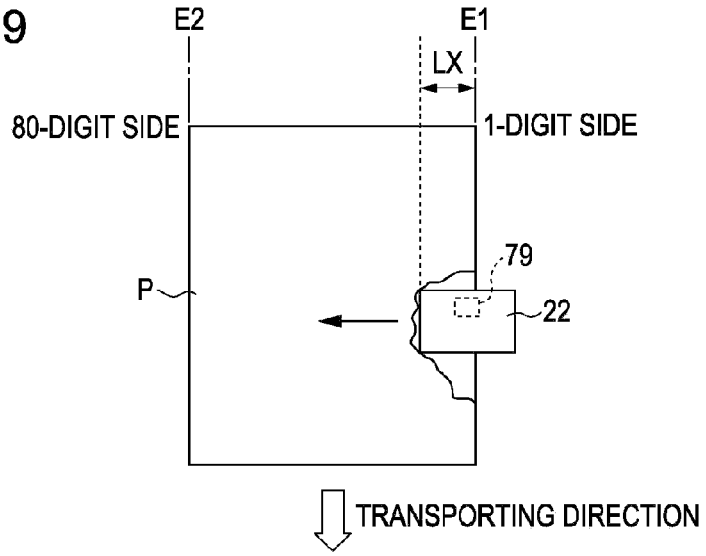
FIG. 9 is a schematic plane view showing a carriage stopped by a paper jam according to a second embodiment.

In the embodiment, as shown in FIG. 9, the extent at which the carriage 22 stopped by the paper jam is positioned in the carriage moving direction (solid arrow direction side in FIG. 9) from an end of the paper P at the carriage activating position (the paper end of the paper P in the 1-digit side in FIG. 9 (1-digit side end E1)) is determined. In the example, as shown in FIG. 9 and (a) of FIG. 10, the set distance LX from the end of the carriage activating position (1-digit side end E1) to the carriage moving direction is set in the paper P. Then, as shown in FIG. 5, the fifth determination section 95 as an example of a carriage position determination unit determines whether a distance L from the end at the carriage activating position (1-digit side end E1) to the end surface of the stopped carriage 22 in the moving direction is equal to or more than the set distance LX in the paper P when the carriage 22 is stopped due to the paper jam caused by the CR motor error.

For details, when the carriage 22 starts (is activated) to move from the 1-digit side, the fifth determination section 95 determines whether the carriage 22 stopped when the paper jam is detected is positioned in the moving direction (80-digit side) by the set distance LX or more from the 1-digit side end E1 of the paper P. In addition, when the carriage 22 starts (is activated) to move from the 80-digit side, the fifth determination section 95 determines whether the carriage 22 stopped when the paper jam is detected is positioned in the moving direction (1-digit side) by the set distance LX or more from an 80-digit side end E2 (refer to FIG. 9) of the paper P.

In the embodiment, the positions of the ends E1 and E2 of the paper P are detected by the paper width sensor 79. For example, when the carriage 22 is firstly moved in the main scanning direction X after the paper P is fed, the paper width sensor 79 detects the ends E1 and E2 of the paper P. When the paper width sensor 79 is, for example, a reflective type sensor, and an OFF state in which light emitted from a light emitter therein does not hit the paper P and a light receiver therein does not receive the reflected light and an ON state in which the emitted light hits the paper P and the reflected light is received by the light receiver are switched, the paper width sensor 79 detects the ends E1 and E2 of the paper P from the carriage position at the time of switching.

Figure 10:
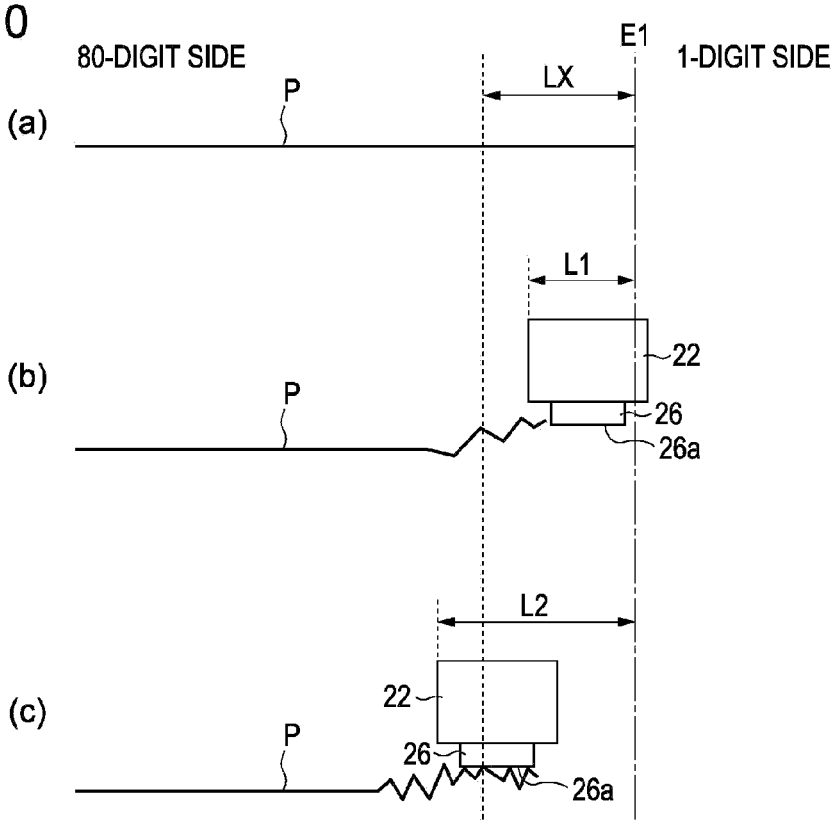
FIG. 10 is a schematic side view describing a determination method of carriage positions.

As shown in (b) of FIG. 10, when the carriage 22 is stopped due to the paper jam, in a case where the distance L from the end of the paper P at the carriage activating position (1-digit side end E1) to the end surface of the stopped carriage 22 in the moving direction (left end surface in (a) to (c) of FIG. 10) is L1 which is less than the set distance LX (L1<LX), there is a high probability that a portion in which the paper P is jammed may not be in contact with the nozzle forming surface 26*a* of the printing head 26, although the paper jam occurs. In this case, since the ink meniscus in the nozzle 26*b* of the printing head 26 is not destroyed, a part of the ink in the nozzle 26*b* is not removed, and the ink in the nozzle 26*b* is not mixed with foreign objects such as paper dust and bubbles, when the instruction to continue printing is given, cleaning is not performed.

On the other hand, as shown in (c) of FIG. 10, when the carriage 22 is stopped due to the paper jam, in the case where the distance L from the end of the paper P at the carriage activating position (1-digit side end E1) to the end surface of the stopped carriage 22 in the moving direction is L2 which is equal to or more than the set distance LX (L2≥LX), there is a high probability that the portion in which the paper P is jammed may be in contact with the nozzle forming surface 26*a* of the printing head 26. In this case, there is a concern that the ink meniscus in the nozzle 26*b* of the printing head 26 may be destroyed, a part of the ink in the nozzle 26*b* may be removed, and the ink in the nozzle 26*b* may be mixed with foreign objects such as paper dust and bubbles. Therefore, since there is a concern that the ejection error of the printing head 26 may be caused by at least one of the above mentioned conditions, when the instruction to continue printing is given, cleaning is performed.

Hereafter, the effects of the printer 11 will be described according to a flow chart shown in FIG. 11. When the jam detecting section 83 detects the paper jam, the CPU 61 executes a program shown in the flow chart of FIG. 11.

Figure 11:
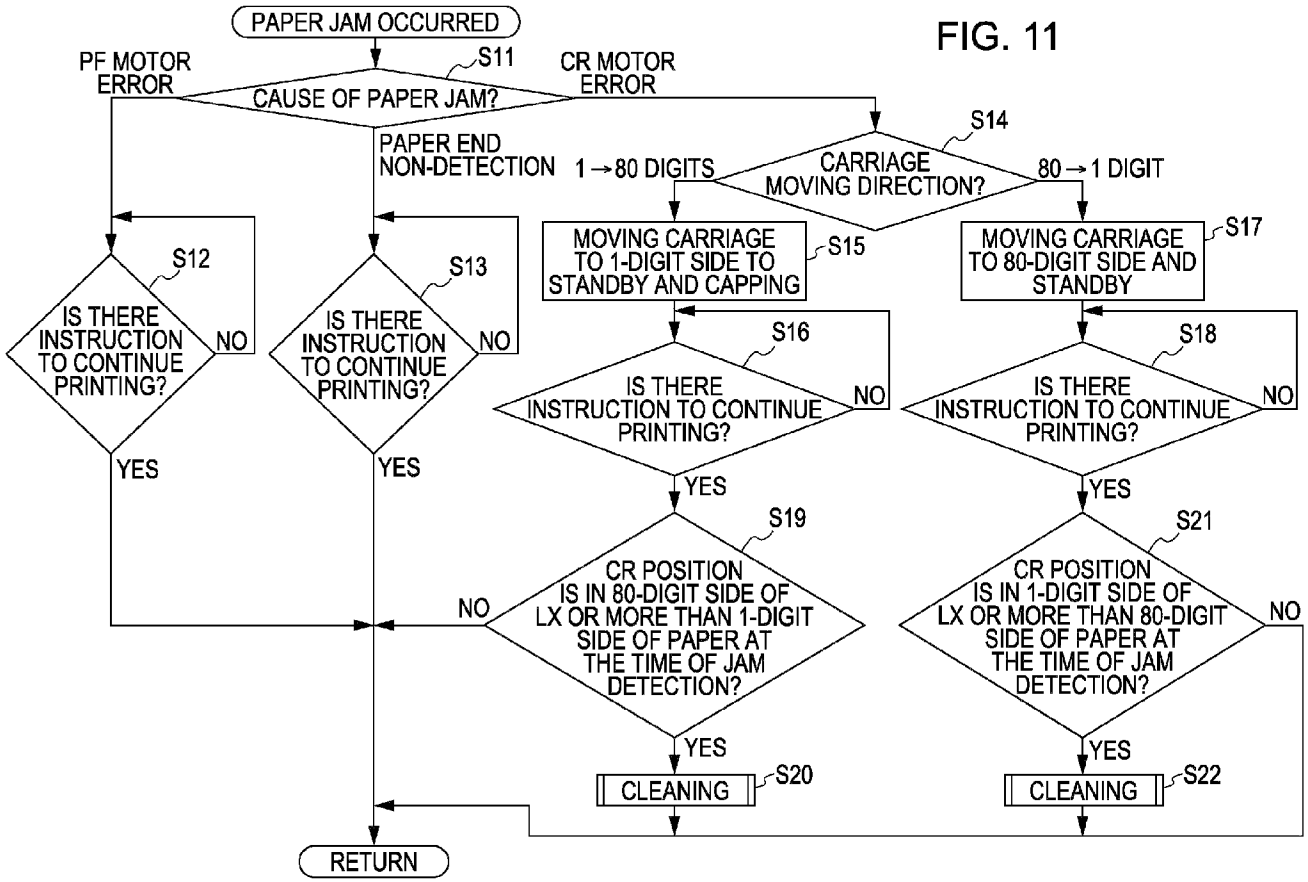
FIG. 11 is a flow chart showing control when a paper jam occurs.

Each process of Step S11 to Step S18 in FIG. 11 is the same as each process of Step S1 to Step S8 in FIG. 8. For this reason, first, when the cause of the paper jam determined in Step S11 is the CR motor error, the process proceeds to Step S14.

In Step S14, when it is determined that the moving direction of the carriage at the time of the paper jam occurrence is the direction from the 1-digit side to the 80-digit side (forward moving direction), the process proceeds to Step S15. Then, in Step S15, the carriage 22 is moved toward the 1-digit side which is the reverse direction of the moving direction when the paper jam occurs to stand by at the home position. At this time, the cap 36 elevated according to the movement of the carriage 22 to the home position is in contact with the nozzle forming surface 26*a* of the printing head 26 and then, the printing head 26 is capped. Therefore, in Step S16, when there is the instruction to continue printing, the process proceeds to Step S19.

On the other hand, in Step S14, when it is determined that the moving direction of the carriage at the time of the paper jam occurrence is the direction from the 80-digit side to the 1-digit side (reverse moving direction), the process proceeds to Step S17. Then, in Step S17, the carriage 22 is moved toward the 80-digit side which is the reverse direction of the moving direction when the paper jam occurs to stand by at the anti-home position. Therefore, in Step S18, when there is the instruction to continue printing, the process proceeds to Step S21.

When the carriage 22 stands by at the home position in the 1-digit side, it is determined whether the carriage position when the paper jam occurs is in the 80-digit side by the set distance LX or more from the end E1 of the paper P in the 1-digit side in Step S19. In case of the negative determination in Step S19, the carriage completes the routine. In other words, as shown in (b) of FIG. 10, when the carriage position at the time of the paper jam detection is not in the 80-digit side by the set distance LX or more from the end E1 of the paper P in the 1-digit side, since there is a high probability that the portion in which the paper P is jammed may not be in contact with the nozzle forming surface 26*a* of the printing head 26, cleaning is not performed. That is, when the distance L from the end E1 of the paper P in the 1-digit side to the end surface of the carriage 22 in the 80-digit side as seen from plan view is L1 which is less than the set distance LX (L1<LX), cleaning is not performed.

Meanwhile, in case of the positive determination in Step S19, the process proceeds to Step S20 and cleaning is performed. In other words, as shown in (c) of FIG. 10, when the carriage position at the time of the paper jam detection is in the 80-digit side by the set distance LX or more from the end E1 of the paper P in the 1-digit side, since there is a high probability that the portion in which the paper P is jammed may be in contact with the nozzle forming surface 26*a* of the printing head 26, cleaning is performed. That is, when the distance L from the end E1 of the paper P in the 1-digit side to the end surface of the carriage 22 in the 80-digit side as seen from plan view is L2 which is equal to or more than the set distance LX (L2≥LX), cleaning is performed.

When the carriage 22 stands by at the anti-home position in the 80-digit side, it is determined whether the carriage position when the paper jam is detected is in the 1-digit side by the set distance LX or more from the end E2 of the paper P in the 80-digit side in Step S21. In a case of the positive determination in Step S21, the process proceeds to Step S22 to perform cleaning. On the other hand, the carriage completes the routine in case of the negative determination in Step S21.

Accordingly, when the stopped carriage position due to the paper jam detection is in the 1-digit side by the set distance LX or more from the end E2 of the paper P in the 80-digit side and there is a high probability that the portion in which the paper P is jammed may be in contact with the nozzle forming surface 26*a* of the printing head 26, cleaning is performed. Meanwhile, when the stopped carriage position due to the paper jam detection is not in the 1-digit side by the set distance LX or more from the end E2 of the paper P in the 80-digit side and there is a high probability that the portion in which the paper P is jammed may not be in contact with the nozzle forming surface 26*a* of the printing head 26, cleaning is not performed.

As described above, the effects (1) and (2) in the first embodiment can be obtained in the same manner and the following effect can be also obtained according to the second embodiment.

(4) When the carriage 22 stopped at the time of the paper jam detection is positioned toward the moving direction by the set distance LX or more from the end of the paper P at the carriage activating position, cleaning is performed. However, when the carriage 22 is positioned toward the moving direction by less than the set distance LX, cleaning is not performed. Accordingly, when there is a high probability that the portion in which the paper P is jammed may not be in contact with the nozzle forming surface 26*a* of the printing head 26, cleaning is not performed so that wasteful cleaning can be avoided as much as possible. Therefore, it is possible to avoid unnecessary increase of the used amount of ink due to the cleaning.

Third Embodiment

Next, the third embodiment will be described using FIG. 12. The third embodiment, is different from the respective embodiments in that a time when the carriage 22 stands by at the anti-home position in which the printing head 26 is not capped at the time of the paper jam detection is set as a condition for performing cleaning, whether the cleaning is performed is determined according to the standby time, and the cleaning level is changed according to the standby time when the cleaning is performed. Since the configuration of the printer 11 is basically the same as the configuration of the first embodiment, only the particularly different configuration will be described.

When the carriage 22 stands by at the anti-home position at the time of the paper jam detection, the time section 90 shown in FIG. 5 times a standby time T in which the carriage 22 stands by at the anti-home position. Then, the sixth determination section 96 as an example of a time determination unit shown in FIG. 5 determines whether the standby time T of carriage 22 in the anti-home position is equal to or more than the set time. In the embodiment, plural set times T1 and T2 are set. The sixth determination section 96 determines whether the standby time T is equal to or more than a first set time T1 (T≥T1), and when it is T≥T1, the sixth determination section 96 further determines whether the standby time T is equal to or more than a second set time T2 (T≥T2). That is, the sixth determination section 96 determines to which of three set time ranges, which are the standby time T is less than the first set time T1 (T<T1), the standby time T is equal to or more than the first set time T1 and less than the second set time T2 (T1≤T<T2), and the standby time T is equal to or more than the second set time T2 (T≥T2), the standby time T belongs.

The cleaning control section 88 shown in FIG. 5 stores a cleaning table CT (refer to FIG. 5) in a memory therein. The cleaning table CT is a table data showing a correspondence relationship between three set time ranges and the cleaning levels. For example, when the standby time T is in the set time range satisfying T<T1, non-cleaning performance is set. Moreover, when the standby time T is in the set time range satisfying T1≤T<T2, a first cleaning which is a weak cleaning level is set. Further, when the standby time T is in the set time range satisfying T≥T2, a second cleaning which is a strong cleaning level is set.

Hereafter, effects of the printer 11 will be described according to a flow chart shown in FIG. 12. When the jam detecting section 83 detects a paper jam, the CPU 61 executes a program shown in the flow chart of FIG. 12.

Figure 12:
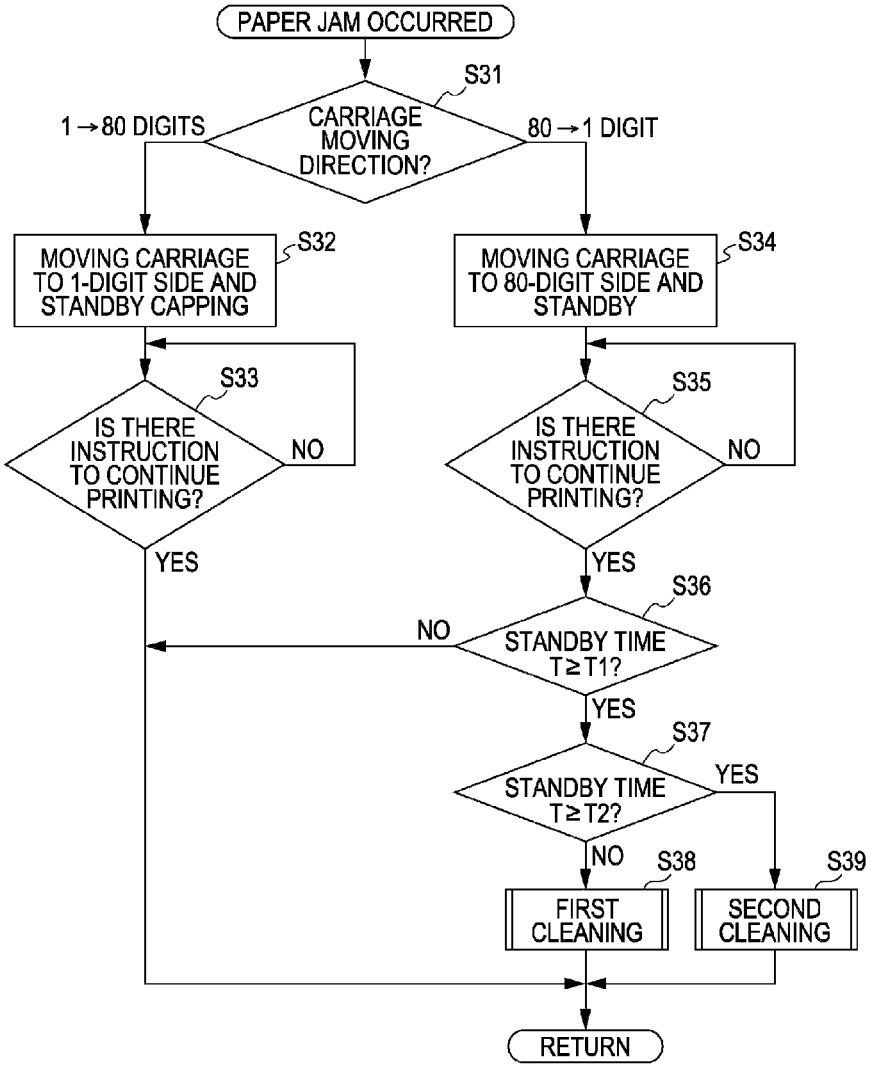
FIG. 12 is a flow chart showing control when a paper jam occurs according to a third embodiment.

Each process of Step S31 to Step S35 in FIG. 12 is the same as each process of Step S4 to Step S8 in FIG. 8. In the embodiment, the cause of the paper jam is not determined, and first, when the paper jam occurs, the moving direction of the carriage at the time of the paper jam occurrence is determined in Step S31. When it is determined that the moving direction of the carriage at the time of the paper jam occurrence is the direction from the 1-digit side to the 80-digit side (forward moving direction), the process proceeds to Step S32. Then, in Step S32, the carriage 22 is moved to the 1-digit side which is the reverse direction of the moving direction of the carriage at the time of the paper jam occurrence to stand by at the home position. At this time, the cap 36 is elevated according to the movement of the carriage 22 to the home position and is in contact with the nozzle forming surface 26*a* of the printing head 26 so that the printing head 26 is capped. In Step S33, when there is the instruction to continue printing, the carriage completes the routine. That is, when the carriage is moved toward the 1-digit side to stand by at the home position and the printing head 26 is capped, there is no concern that the ink in the nozzle 26*b* may dry to cause the ejection error, and then cleaning is not performed.

On the other hand, in Step S31, when it is determined that the moving direction of the carriage at the time of the paper jam occurrence is the direction from the 80-digit side to the 1-digit side (reverse moving direction), the process proceeds to Step S34. Then, in Step S34, the carriage 22 is moved to the 80-digit side which is the reverse direction of the moving direction of the carriage at the time of the paper jam occurrence to stand by at the anti-home position. At this time, the printing head 26 is not capped. In the printing head 26 of the uncapped state, the ink in the nozzle 26*b* gradually dries as time passes. For this reason, when the standby time T in which the printing head 26 stands by at the anti-home position in the uncapped state exceeds a certain threshold value, there is a concern that the ink in the nozzle 26*b* may dry to cause the ejection error. Then, the user who releases the paper jam, operates the operation unit 16 to give an instruction to continue printing so that when there is the instruction to continue printing in Step S35, the process proceeds to Step S36.

In the embodiment, the time section 90 times the standby time T after the carriage 22 reaches the anti-home position (that is, elapsed time in the uncapped state after the carriage is withdrawn). In Step S36, it is determined whether the standby time T is equal to or more than the set time T1 (T≥T1). When T≥T1 is not established, that is, when it is T<T1, the carriage completes the routine. In other words, when the standby time T is in a range of less than the set time T1, the ink in the nozzle 26*b* does not dry to cause the ink ejection error, cleaning is not performed. Meanwhile, when T≥T1 is established, the process proceeds to Step S37.

In Step S37, it is determined whether the standby time T is equal to or more than the set time T2 (T≥T2). When T≥T2 is not established, that is, when the standby time T is in a range of equal to or more than the set time T1 and less than the set time T2 (T1≤T<T2), the process proceeds to Step S38 and the first cleaning of a weak level is performed. On the other hand, when T≥T2 is established in Step S37, that is, the standby time T is in a range of equal to or more than the set time T2, the process proceeds to Step S39 and the second cleaning of a strong level is performed.

As described above, the following effects can be obtained according to the third embodiment.

(5) When the carriage 22 stands by at the anti-home position in which the printing head 26 is not capped at the time of the paper jam detection, cleaning is performed, and when the carriage 22 stands by at the home position in which the printing head 26 is capped, cleaning is not performed. Therefore, when the printing head 26 is capped and the carriage 22 stands by at the home position in which there is no concern for drying the ink in the nozzle 26*b*, it is possible to avoid performing unnecessary cleaning and to avoid unnecessary increase in the used amount of ink by the cleaning.

(6) Even in the case where the carriage 22 stands by at the anti-home position (uncapped state) at the time of the paper jam detection, when the standby time T is less than the set time T1, cleaning is not performed. Therefore, it is possible to reduce the number of operations of performing cleaning as much as possible and to suppress the used amount of ink by the cleaning as much as possible.

(7) When the carriage 22 stands by at the anti-home position at the time of the paper jam detection and the standby time T is in the range of equal to or more than the set time T1 and less than the set time T2 (T1≤T<T2), the first cleaning of a weak level is performed, and when the standby time T is in the range of equal to or more than the set time T2(T≥T2), the second cleaning of a strong level is performed. Therefore, it is possible to perform appropriate cleaning with an appropriate suction amount of ink when cleaning is performed and to avoid wasteful increase in the used amount of ink. In addition, the ejection error caused by drying the ink in the nozzle 26*b* can be effectively prevented.

The invention is not limited to the respective embodiments, and can be realized in the following aspects.

In the first embodiment, it is determined whether cleaning is performed according to the fact that the transporting position of the paper is in the one-side supporting range or in the both-side supporting range. However, when the paper jam occurs due to the CR motor error irrespective of the transporting position y, cleaning may be usually performed. According to the configuration, when the paper jams caused by the PF motor error and the paper end non-detection are detected, wasteful cleaning is not performed and the used amount of ink by the cleaning can be suppressed as much as possible.

In the second embodiment, the same processes are performed between Steps S16 and S19 and between Steps S18 and S21 as in Step S9 of the first embodiment. In this case, when the paper position is in the one-side supporting range (process determination in the same process as S9), the carriage position at the time of the paper jam detection is in the 80-digit side by the set distance LX or more from the end of the paper in the 1-digit side (positive determination in S19) and the carriage position at the time of the paper jam detection is in the 1-digit side by the set distance LX or more from the end of the paper in the 80-digit side (positive determination in S21), cleaning is performed. Accordingly, when the paper position is in the both-side supporting range, cleaning is not performed. Even when the paper position is in the one-side supporting range, in the case where the carriage position at the time of the paper jam detection is not in the 80-digit side by the set distance LX or more from the end of the paper in the 1-digit side (negative determination in S19) and the carriage position at the time of the paper jam detection is not in the 1-digit side by the set distance LX or more from the end of the paper in the 80-digit side (negative determination in S21), cleaning is not performed.

In the second embodiment, the set distance is set as "LX" only. However, plural set distances may be set and cleaning levels may be changed according to the carriage position in which a distance to the position of the carriage stopped due to the paper jam from the end of the paper is equal to or more than the set distance.

In the third embodiment, the number of times of setting a set time or the number of setting a set time range can be appropriately changed. For example, only one set time may be set, two set time ranges may be set, and whether the cleaning is performed based on the standby time T is determined. When the cleaning is performed, a configuration in which the cleaning of one level is performed can be adopted. In addition, three or more set times may be set, and whether the cleaning is performed based on the setting time ranges in which the standby time T belongs is determined. When the cleaning is performed, a configuration in which the cleaning level can be selected from three levels or more can be also adopted.

In the third embodiment, it is possible to adopt a configuration to detect a paper jam by monitoring the load (for example, torque) of the carriage motor so that an extra load which allows estimation of the occurrence of a jam of the printing medium is applied.

In the printer not including the paper width sensor 79 according to the second embodiment, the positions of the ends E1 and E2 of the paper P may be obtained by using the paper size information included in the printing data as one piece of the printing condition information. In other words, as long as the paper size is determined, the positions of the ends E1 and E2 of the paper P are uniquely determined. Therefore, the positions of the ends E1 and E2 of the paper P may be obtained by referring to the table or calculation based on the paper size information.

In the respective embodiments, the functional blocks built in the computer (FIG. 5) is realized in the software by causing the CPU to execute the program but it is not limited to thereto. It may be realized in hardware by an electronic circuit in the computer, for example. Further, it may be realized in cooperation with the software and the hardware.

The printing medium is not limited to cut paper and rolled paper may be used. In addition, the printing medium is not limited to paper, and a film, sheet, metal, fabric or the like may be used.

In the respective embodiments, the ink jet type printer 11 (printing apparatus) is adopted, but a fluid ejecting apparatus which ejects or discharges other liquids (liquid bodies) other than ink may be adopted as a printing apparatus. Herein, the "printing" is not limited to the printing of images or documents by ejecting liquid such as ink to form a print pixel, and the printing is widely defined as "ejecting liquid and attaching the ejected liquid to a medium". In this meaning, the printing apparatus widely includes various liquid ejecting apparatuses having liquid ejecting heads or the like for discharging a minutely small amount of liquid drops. In this case, the liquid drop denotes a state of a liquid ejected from the aforementioned liquid ejecting apparatuses and also includes liquid drops leaving a tail in a granular state, a tear-like state, and a thread-like state. In addition, the liquid referred to herein may be a material which can be ejected by the liquid ejecting apparatuses. For example, a material in a liquid state may be used. In addition, a liquid body having a high or low viscosity, a sol solution, a gel water, other fluids such as inorganic solvents, organic solvents, solutions, liquid resins, and liquid metals (metal melt) may be included. In addition, a material where particles of a functional material made of a solid material such as pigments or metal particles are dissolved in a solvent, dispersed, or mixed in as well as a liquid as a single phase material may be included. In addition, as representative examples of the liquid, there may be an ink and a liquid crystal. Herein, the ink may include general water-based ink and oil-based ink and various types of liquid compounds such as a gel ink and a hot-melt ink. As specific examples of a liquid ejecting apparatus, there may be a liquid ejecting apparatus configured to eject liquid including materials such as electrode material or coloring material used for manufacturing liquid crystal displays, EL (electroluminescence) displays, surface-emission-type displays or a color filter in a dispersed or dissolved state. In addition, there may be a liquid ejecting apparatus which ejects a biological organic substance used for manufacturing biochips, a liquid ejecting apparatus used as a precise pipette and configured to eject liquid as samples, a print apparatus and a microdispenser. Moreover, a liquid ejecting apparatus configured to eject transparent resin liquid such as ultraviolet ray cured resin on a substrate for forming micro semispherical lenses (optical lenses) used for optical communication elements, and a liquid ejecting apparatus configured to eject etching solution such as acid or alkali for etching a substrate (printing medium) or the like may be used, and the invention may be applied to any one of these liquid ejecting apparatuses.

What is claimed is:

1. A printing apparatus comprising:

a driving unit that moves a carriage having a liquid ejecting head which ejects liquid to a printing medium;

a cleaning unit that performs cleaning on the liquid ejecting head;

a detecting unit that detects a jam of the printing medium based on change in operation of the carriage;

a control unit that controls the driving unit to move the carriage and stops the driving of the driving unit to stop the carriage movement when the detecting unit detects the jam;

an instruction unit that is operated to give an instruction to continue printing after the jam is released;

a cleaning control unit that causes the cleaning unit to perform cleaning on the liquid ejecting head when the instruction to continue printing is given from the instruction unit;

a transporting unit which transports the printing medium in a transporting direction crossing a moving direction of the carriage and has a pair of transporting rollers in each of an upstream side and a downstream side of the transporting direction with respect to the liquid ejecting head; and a determination unit that determines whether the printing medium is in a one-side supporting state in which the printing medium is supported by only one of the pairs of transporting rollers or in a both-side support state in which the printing medium is supported by both of the pairs of transporting rollers when the detecting unit detects the jam of the printing medium, wherein, when the instruction to continue printing is given from the instruction unit, the cleaning control unit causes the cleaning unit to perform cleaning in the case where it is determined that the printing medium is in the one-side supporting state by the determination unit, and the cleaning control unit causes the cleaning unit not to perform cleaning in the case where it is determined that the printing medium is in the both-side support state.

2. The printing apparatus to according to claim 1, further comprising:

a carriage position detecting unit that detects a position of the carriage in the moving direction; and a carriage position determination unit that determines whether a distance from an end position of a carriage movement start position to the stopped carriage position at the time of the jam detection exceeds a threshold value in the printing medium, wherein, when the instruction to continue printing is given from the instruction unit, the cleaning control unit causes the cleaning unit to perform cleaning in the case where it is determined that the distance exceeds the threshold value, and the cleaning control unit causes the cleaning unit not to perform cleaning in the case where it is determined that the distance is equal to or less than the threshold value.

3. A printing apparatus comprising:

a driving unit that moves a carriage having a liquid ejecting head which ejects liquid to a printing medium;

a cleaning unit that performs cleaning on the liquid ejecting head;

a jam detecting unit that detects a jam of the printing medium;

a direction determination unit that determines a moving direction of the carriage;

a carriage control unit that controls the driving unit to move the carriage and withdraw the carriage in a reverse direction of the moving direction of the carriage at the time of the jam detection determined by the direction determination unit when the jam detecting unit detects the jam;

a capping unit that is capable of capping the liquid ejecting head provided in one end in a movement path of the carriage;

an instruction unit that is operated to give an instruction to continue printing after the jam is released;

a cleaning control unit that causes the cleaning unit to perform cleaning on the liquid ejecting head in the case where the carriage is withdrawn in a position opposite to the capping unit, and the cleaning control unit causes the cleaning unit not to perform cleaning on the liquid ejecting head in the case where the carriage is withdrawn in a position of the capping unit side, when the instruction to continue printing is given from the instruction unit;

a time determination unit that determines whether a standby time of the carriage withdrawn in the position opposite to the capping unit is equal to or more than set time, wherein the cleaning control unit causes the cleaning unit to perform cleaning on the liquid ejecting head when it is determined that the standby time is equal to or more than the set time by the time determination unit; and wherein the cleaning control unit causes the cleaning unit to perform a first cleaning in the case where it is determined that the standby time is equal to or more than a first set time and less than a second set time by the time determination unit, and the cleaning control unit causes the cleaning unit to perform a second cleaning stronger than the first cleaning in the case where it is determined that the standby time is equal to or more than the second set time.

* * * * *